United States Patent [19]

Stein

[11] Patent Number: 4,892,187

[45] Date of Patent: Jan. 9, 1990

[54] DRINKING APPARATUS

[76] Inventor: Peter Stein, 1221 N. Courthouse Rd. 311, Arlington, Va. 22201

[21] Appl. No.: 313,030

[22] Filed: Mar. 15, 1989

Related U.S. Application Data

[63] Continuation of Ser. No. 190,116, May 4, 1988, abandoned.

[51] Int. Cl.[4] ..... B65D 83/00

[52] U.S. Cl. ..... 206/217; 215/1 A; 220/90.2

[58] Field of Search ..... 206/217; 215/1 A; 220/90.2, 90.4

[56] References Cited

U.S. PATENT DOCUMENTS

| | | | |
|---|---|---|---|
| 3,656,654 | 4/1972 | Brinkley, III | 220/90.2 |
| 4,109,817 | 8/1978 | Payne et al. | 220/90.2 |
| 4,228,913 | 10/1980 | Mack et al. | 220/90.2 |
| 4,305,521 | 12/1981 | Komatsuta et al. | 220/90.2 |
| 4,356,927 | 11/1982 | Cooper et al. | 220/90.2 |
| 4,537,324 | 8/1985 | Wang | 220/90.2 |
| 4,690,294 | 9/1987 | Jones | 220/90.2 |
| 4,709,829 | 12/1987 | Johnson et al. | 220/90.2 |
| 4,728,001 | 3/1988 | Serba | 220/90.2 |
| 4,826,034 | 5/1989 | Forbes | 220/90.2 |

*Primary Examiner*—Jimmy G. Foster

[57] ABSTRACT

A pop-up straw having an upper buoyant section and a lower flexible section is mounted within a container. When the container is opened, the upper end of the pop-up straw rises through the opening. The straw is particularly useful with a push in tab easy open end container. A collar which holds the upper portion of the straw is mounted below the opening and just below the downward extension of the tab. Opening the tab pushes downward against the upper end of the straw until the tab clears the upper end of the straw. The upper end of the straws then pops up through the opening.

3 Claims, 3 Drawing Sheets

DRINKING APPARATUS

This is a continuation of application Ser. No. 07/190,116 filed May 4, 1988 and abandoned Mar. 23, 1989.

BACKGROUND OF THE INVENTION

The invention relates generally to drinking straws and to pop-up straws for beverage containers.

A pop-up straw for beverage cans has been described in Patent No. 4,356,927, but the use of that straw requires a removeable tab on the top wall of the can. A plurality of accordian pleats which are upwardly tilted to form air traps or are compressed so as to urge the upper end of a straw in an upward direction. The patent also describes rounded guides which extend from one end of a sidewall which is rolled and seamed.

Difficulties exist in that prior art in that most cans are made with a deep drawing process in which it is difficult to form guides on a sidewall. Many state laws require that tabs of easy open ends remain attached to the container after the container is opened. Consequently many cans have tabs which are pushed downward into the can as the can is opened. The use of such downward opening cans would tend to misalign the straws of Patent No. 4,356,927 with the openings which would tend to render those straws unuseable.

In the aforesaid patent a compressed straw is held between a groove in the can bottom and a downward dimple in the detachable tab. Aligning the straw filling and closing of the can may be extremely difficult. In another embodiment of the patent guides formed from tongues at edges of seamed cans are difficult to provide because seamed cans are not in wide use. The trapping of air in particular formed corregations may be extremely difficult.

Problems remain in the prior art which are solved by the present invention.

SUMMARY OF THE INVENTION

The present invention provides a straw with a flexible lower portion and a straight upper portion with elevator means. The present invention provides a channel and elevator means which allow a pop-up straw to be used with an inward bent attached tab.

The present invention provides a collar and attachment means for mounting the straw at the time of filling and sealing the can. These and further and other objects and features of the invention are apparent in the disclosure which includes the above and ongoing description, with the claims and the drawings.

DETAILED DESCRIPTION OF THE DRAWINGS

Figure 1:
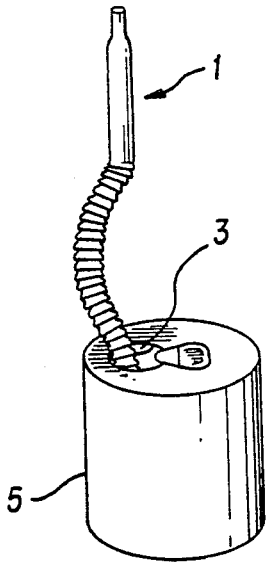
FIG. 1 is a schematic view of a can with an extended straw.
Figure 2:
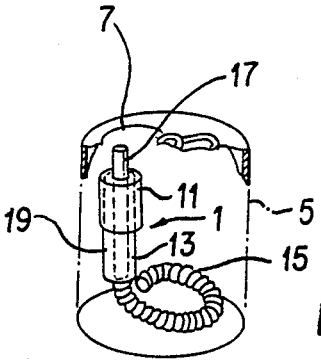
FIG. 2 shows a view of a can partially in section with an enclosed straw.

A straw 1 of the present invention is shown extended from an opening 3 in a can 5 in FIG. 1. In FIGS. 2 a tab 7 closes the opening 3, holding the straw 1 within the can. A collar 11 positioned slightly below the opening 3 holds the upper portion 13 of the straw while the lower portion 15 is bent and is spaced above the bottom of the can. The upper end 17 of the straw rests against the lower side of the tab. The collar 11 has two functions, first to guide the straw straight downward as the tab 7 is bent downward in the can, and then to guide the straw straight upward after the tab edge has passed the upper end 17 of the straw. The collar 11 also serves to straighten the lower portion 15 of the straw as it is pulled upward when the can is opened.

The lower portion 15 of the straw 1 is flexible in the sense that it is bendable and pliable but is not resilient, so that the lower portion 15 retains its shape when bent.

As shown in FIG. 2 the upper portion 13 of the straw has an elevator means 19 which is a buoyant portion of the straw. The elevator means 19 slides freely through the collar 11.

Figure 3:
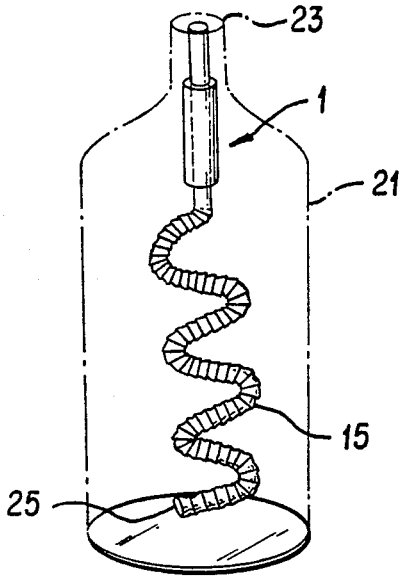
FIG. 3 shows a closed bottle containing a pop-up straw.

As shown in FIG. 3 a bottle 21 with a cap 23 holds a straw 1 in the bottle until the cap is opened. As in the case of the can the straw has a sufficiently long lower portion 15 so that the lower end 25 almost reaches the bottom of the container.

Figure 4:
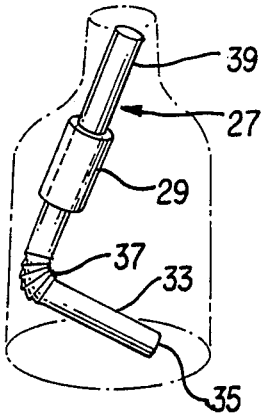
FIG. 4 shows an enclosed bottle containing an alternate pop-up straw.

An alternate form of the pop-up straw 27 is shown in FIG. 4. That straw has an elevator portion 29, a straight upper portion 39, a straight lower portion 33 with a lower end 35 and a flexible mid-portion 37.

The straws in the invention may be made of any suitable material such as a plastic material. The elevator portions 19 and 29 may be closed cell rings which are shrunk on the straw or which are integrally formed with the straw body. Alternatively the straw may be made of a material which is less dense than the beverage.

The inside dimensions of a beverage can are about 105 millimeters minimum height, upper end diameter 60 millimeters, the tab diameter 20 millimeters.

Figure 5:
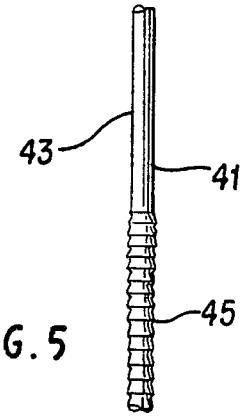
FIG. 5 shows a pop-up straw of the present invention.
Figure 6:
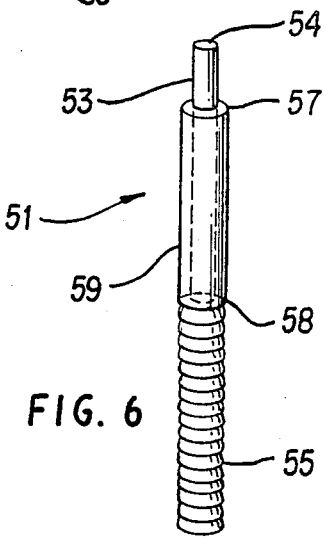
FIG. 6 shows a pop-up straw of the present invention.

As shown in FIG. 5 a pop-up straw 41 has an upper portion 43 and a lower flexible portion 45. The upper portion is approximately 6 millimeters in diameter and 80 millimeters long and the lower portion is approximately 6.8 millimeters in diameter and 90 millimeters long. The straw in FIG. 5 can be entirely buoyant if the plastic density is half of the water's or the elevator can be separated from the straw. As shown in FIG. 6 a straw 51 has an upper portion 53 and a lower portion 55. A buoyant portion 59 is made of a hollow wall tube having upper and lower ends 57 and 58 sealed to the inner portion 53 and lower portion 55 respectively. As shown in FIG. 6 the inner portion 53 is about 4.4 millimeters in diameter and has a wall thickness of about 0.2 millimeters. The lower flexible portion 55 is about 6.8 millimeters in diameter and about 90 millimeters long. The buoyant portion 59 is about 6 millimeters in diameter and about top 54 of the inner straw 53 extends about 20 millimeters above the elevator portion 59.

Figure 7:
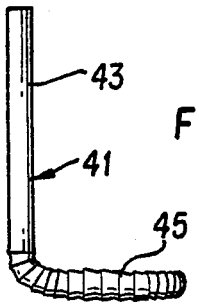
FIG. 7 is a side view of a pop-up straw of the present invention.
Figure 8:
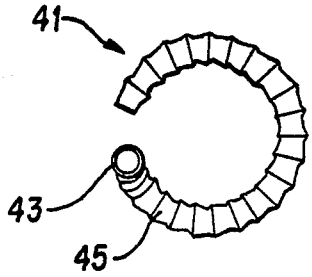
FIG. 8 is a top view of the straw shown in FIG. 7.

As shown in FIG. 7 a pop-up straw such as 41 when positioned in a can has a height of about 88 millimeters and a diameter of a lower portion 45 of about 45 millimeters. FIG. 8 shows the curved arrangement of the lower portion.

Figure 9:
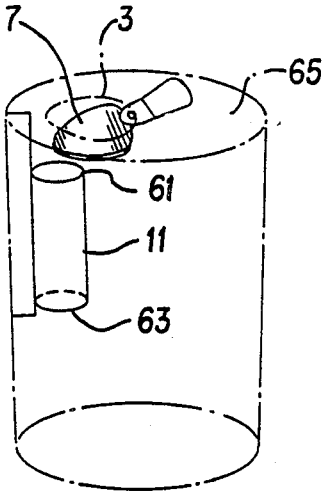
FIG. 9 is a perspective view of a collar, mounting strut and can tab in an open position.
Figure 10:
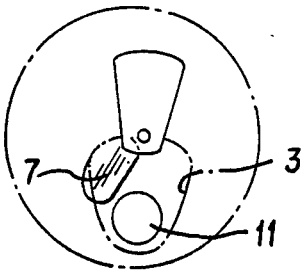
FIG. 10 is a top view of the elements shown in FIG. 9.

As shown in FIGS. 9 and 10 the collar 11 is centered near the side of opening 3. The top 61 of collar 11 is positioned about 20 millimeters beneath the upper end of the can and the bottom 63 of collar 11 is positioned about 45 millimeters below the upper end 65 of the can. The diameter of the collar is about 8.5 millimeters.

Figure 11:
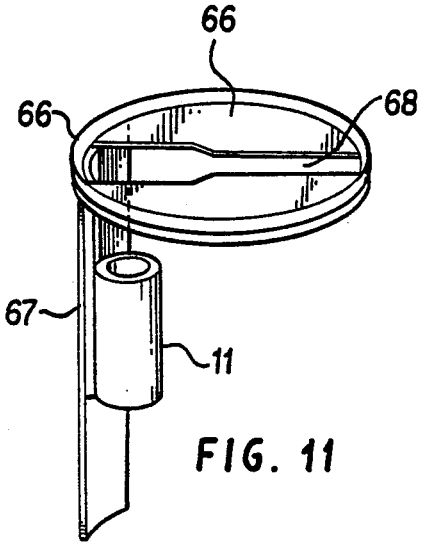
FIG. 11 is showing an independent support for the mounting of the collar of the present invention.
Figure 12:
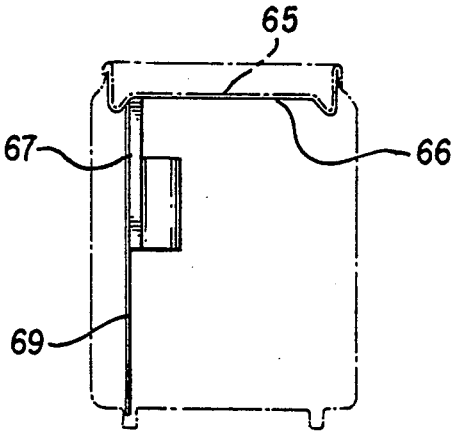
FIG. 12 shows the support of FIG. 11 in a can.
Figure 13:
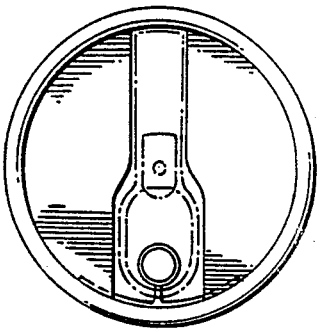
FIG. 13 is a top view of a can shown in FIG. 12.
Figure 14A:
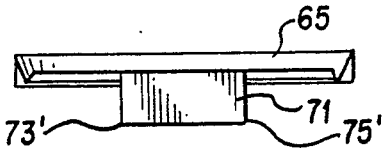
FIG. 14*a* is a side elevation of a can end and bayonet mount.
Figure 14B:
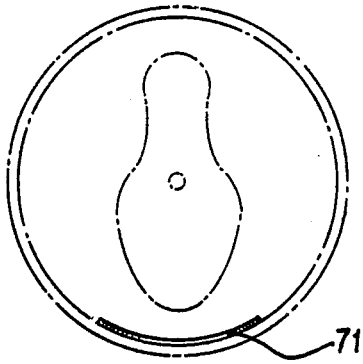
FIG. 14*b* is a top view of the apparatus shown in FIG. 14*a*.
Figure 17:
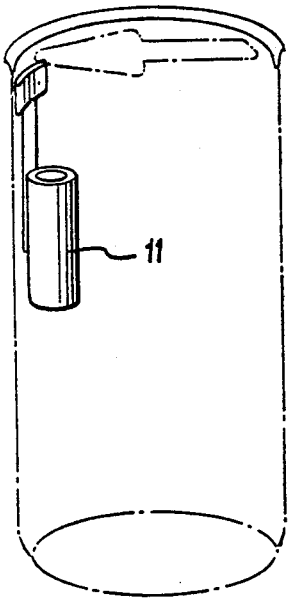
FIG. 17 is a detail of the mounted elements of FIGS. 14*a*–16.

As shown in FIGS. 11, 12 and 13 the collar 11 is supported by a strut 67 which extends from the upper end insert 66, downward along the curved support 69 parallel to the sidewall of the can. The bottom of curved support 69 may fit in a circular depression on the can bottoms. Insert 66 has a central opening 68 in which are received the easy opening elements of conventional easy opening end 65. The insert 66 is positioned immediately inside end 65.

FIG. 11 shows an independent support completely separated from the can and the can top molded from plastic or the can metal or made of the can metal. It has an upper end 66. The upper end 66 has a cut off position above the collar that fits the slight depression of the can top.

In FIG. 12 the can is drawn with a broken line 69 is parallel to the sidewall 66 is the support upper end.

Figure 15:
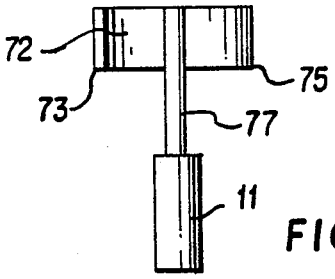
FIGS. 15 and 16 are front and top views of a hanger and collar and receiver of the present invention for attaching to the bayonet mount.
Figure 16:
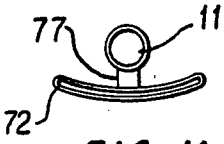

FIGS. 14–20 show preferred hangers for collars 11. As shown in the front view of 14*a* and the bottom plan view of the can and in 14*b* hanger bayonet mount 71 is attached to the easy open end 65. As shown in FIG. 16 bayonet receiver 72 has a strut 77 which is attached to the collar 11. Hanger 71 in FIG. 14*a* and 14*b* belongs to the can upper end and it can be a narrow depression of the can upper end.

Figure 18:
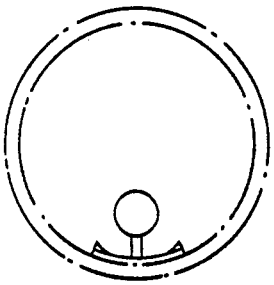
FIGS. 18, 19 and 20 are top, front and side details of the form of the invention shown in FIGS. 14*a*–17.
Figure 19:
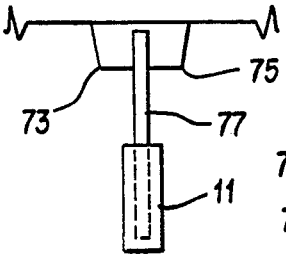
Figure 20:
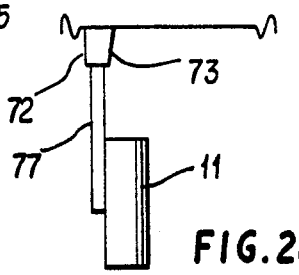

FIG. 15 shows a push-over hanger 72 made of can metal to be pushed over hanger 71 and afterwart it's fixed there by bending peaks 73 and 75 and enclosed portions 73' and 75' of bayonet mount 71 as shown in FIGS. 18–20.

While the invention has been described with reference to specific embodiments, modifications and variations of the invention may be constructive without departing from the scope of the invention which is defined in the following claims.

I claim:

1. Drinking apparatus comprising a pop-up straw submerged in a beverage can, said straw including an upper end face, said can containing or including a strut, said can containing a beverage and connection means for connecting the straw to the strut and elevation means for emerging the upper portion of the straw upwardly and outward from the can when the can is opened, the beverage can having a fracture-and-press-in sealing tab on an upper end wall of the can for opening the can, the tab being moveable inwardly within the can, said upper end face of the straw being installed inside the can directly beneath the opening and beneath the tab.

2. Drinking apparatus comprising a pop-up straw submerged in a beverage can, said straw including an upper end face, said can containing a beverage and a collar and elevation means for emerging the upper portion of the straw upwardly and out of the can when the can is opened, the beverage can having a fracture-and-press-in sealing tab on an upper end wall of the can for opening the can, the tab being moveable inwardly within the can, the beverage can having said upper end face of the straw installed inside the can directly beneath the opening and beneath the tab, the orifice of said collar restricting movement of the straw.

3. Drinking apparatus comprising a pop-up straw submerged in a beverage can, said straw including an upper end face, said can containing a beverage and a collar and elevation means for emerging the upper portion of the straw upwardly and out of the can when the can is opened, the pop-up straw in essence having an unchangeable shape unless it is pulled through the collar outward from the can, the beverage can having a fracture-and-press-in sealing tab on an upper end wall of the can for opening the can, the tab being moveable inwardly within the can, the beverage can having said collar installed inside the can directly beneath the opening and beneath the tab, the orifice of said collar restricting movement of the straw.

* * * * *